US011254531B2

(12) United States Patent
Hirabayashi et al.

(10) Patent No.: US 11,254,531 B2
(45) Date of Patent: Feb. 22, 2022

(54) SHEET GUIDE MECHANISM AND PRINTING APPARATUS

(71) Applicant: SEIKO EPSON CORPORATION, Tokyo (JP)

(72) Inventors: Kenichi Hirabayashi, Shiojiri (JP); Taku Hirashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/803,440

(22) Filed: Feb. 27, 2020

(65) Prior Publication Data

US 2020/0277151 A1 Sep. 3, 2020

(30) Foreign Application Priority Data

Mar. 1, 2019 (JP) ..... JP2019-037296

(51) Int. Cl.
*B65H 5/38* (2006.01)
*B41J 11/20* (2006.01)
*B41J 25/312* (2006.01)

(52) U.S. Cl.
CPC ..... *B65H 5/38* (2013.01); *B41J 11/20* (2013.01); *B41J 25/312* (2013.01)

(58) Field of Classification Search
CPC ..... B65H 5/38; B41J 11/20; B41J 25/312
See application file for complete search history.

(56) References Cited

U.S. PATENT DOCUMENTS 6,491,459 B2 * 12/2002 Hosomi ..... B41J 15/042 400/613
8,985,730 B2 3/2015 Gotschewski
9,227,445 B2 * 1/2016 Murata ..... B41J 29/02
2015/0014474 A1 * 1/2015 Hirabayashi ..... B65H 23/0322 242/615.3
2016/0159601 A1 6/2016 Nakatsu et al.
2020/0276846 A1 * 9/2020 Hirabayashi ..... B41J 29/13
2020/0276848 A1 * 9/2020 Hirabayashi ..... B41J 29/02

FOREIGN PATENT DOCUMENTS

JP 2015-020875 2/2015
JP 2018-039234 3/2018

* cited by examiner

*Primary Examiner* — Howard J Sanders
(74) *Attorney, Agent, or Firm* — Workman Nydegger

(57) ABSTRACT

While a cover moves to a closed position, a second engagement portion contacts a first engagement portion to displace the first engagement portion, and thus a guide portion moves to a guide position. While the cover moves from the closed position to a first open position, the second engagement portion and the first engagement portion are separated, and the guide portion moves from the guide position to an open position.

4 Claims, 11 Drawing Sheets

SHEET GUIDE MECHANISM AND PRINTING APPARATUS

The present application is based on, and claims priority from JP Application Serial Number 2019-037296, filed Mar. 1, 2019, the disclosure of which is hereby incorporated by reference herein in its entirety.

BACKGROUND

1. Technical Field

The present disclosure relates to a sheet guide mechanism and a printing apparatus.

2. Related Art

A printing apparatus that performs printing on a sheet-like printing medium such as paper has been known in the related art that includes a sheet guide mechanism for holding an end portion of the printing medium (for example, see JP-A-2015-20875).

In the above-described printing apparatus in the related art, a lot of work is required when the printing medium is set to the sheet guide mechanism. For example, in the printing apparatus described in JP-A-2015-20875, an operation of moving a guide portion that holds the printing medium to an open position is necessary after an operation of opening a cover of the printing apparatus. Furthermore, an operation of arranging the printing medium on the sheet guide mechanism, an operation of moving the guide portion to a guide position, and an operation of closing the cover are necessary. Thus, it is desired to reduce a work burden when the printing medium is set and the like.

The present disclosure has been made in view of the circumstances described above, and an object of the present disclosure is to facilitate work necessary for setting a sheet medium and the like in a configuration in which a printing apparatus that performs printing on the sheet medium includes a sheet guide mechanism for guiding the sheet medium.

SUMMARY

An aspect that solves the above-described problem is a sheet guide mechanism for sandwiching a sheet medium between a reception portion and a guide portion and guiding the sheet medium, the guide portion being configured to be movable to a guide position in which the guide portion faces the reception portion and sandwiches the sheet medium and to an open position in which the sheet medium is insertable and removable from between the reception portion and the guide portion, the sheet guide mechanism including a cover configured to cover the sheet medium, and a first engagement portion configured to engage with the guide portion, and move the guide portion to the guide position, where the cover is movable to a closed position in which the cover covers the sheet medium and to an open position in which the cover forms an opening that allows handling of the sheet medium, and includes a second engagement portion configured to contact the first engagement portion in the closed position, while the cover moves to the closed position, the second engagement portion contacts the first engagement portion to displace the first engagement portion, and thus the guide portion moves to the guide position, and while the cover moves from the closed position to the open position, the second engagement portion and the first engagement portion are separated, and the guide portion moves from the guide position to the open position.

The sheet guide mechanism described above further includes a biasing member configured to bias the guide portion toward the open position. While the cover moves to the closed position, the guide portion may be pressed, by the first engagement portion, against a biasing force of the biasing member, and the guide portion may move to the guide position.

In the sheet guide mechanism described above, the reception portion and the guide portion may be disposed at two locations away from each other in a width direction intersecting a transport direction of the sheet medium, and at least any of the reception portion and the guide portion may include a regulating surface that abuts the sheet medium to regulate movement in the width direction of the sheet medium.

In the sheet guide mechanism described above, at least one of the two reception portions may be movable in the width direction of the sheet medium.

Another aspect that achieves the above-described object is a printing apparatus including a transport unit configured to transport the sheet medium, a printing unit configured to perform printing on the sheet medium, and the described sheet guide mechanism, where the sheet medium transported by the transport unit is guided by the sheet guide mechanism.

DESCRIPTION OF EXEMPLARY EMBODIMENTS

Figure 1:
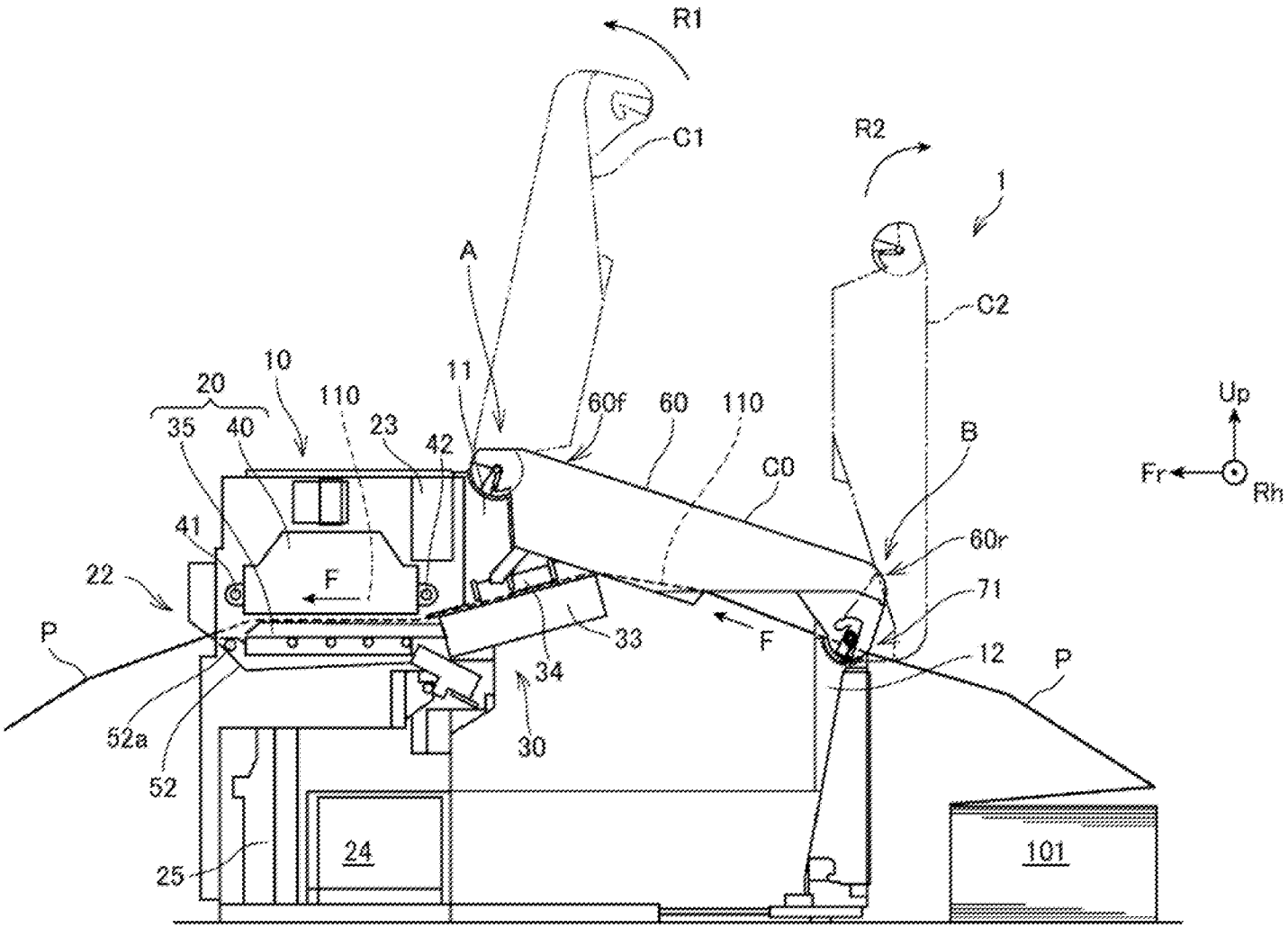
FIG. 1 is a side view illustrating an internal structure of a printing apparatus loaded with fanfold paper.

Exemplary embodiments of the present disclosure are described below with reference to the accompanying drawings. In the drawings, a reference sign Up represents an upper side, a reference sign Fr represents a front side, and a reference sign Rh represents a right side.

As illustrated in FIG. 1, a printing apparatus 1 includes a printing apparatus main body 10. The printing apparatus main body 10 is provided with a printing unit 20 that performs printing on a recording medium, a housing portion 21 that houses the recording medium, and a cover 60 that covers the housing portion 21. In the printing apparatus main body 10, the housing portion 21 is provided behind the printing unit 20.

A sheet P illustrated in FIG. 1 is fanfold paper 101. The sheet P is guided to a paper guide 33 and a paper holder 34, and is fed to the printing unit 20 on the front side. The sheet P printed by the printing unit 20 is discharged from a paper exit 22 formed on a front surface of the printing apparatus 1. The paper guide 33 is a rest that supports the sheet P from below. The paper holder 34 is located above the sheet P so as to face the paper guide 33, and holds down floating of the sheet P.

The printing unit 20 is disposed in front of the paper guide 33 and the paper holder 34. The printing unit 20 includes a platen 35, a printing head 40, and carriage guide shafts 41 and 42. The printing head 40 in the present exemplary embodiment can spray ink in a plurality of colors. As the ink that can be sprayed, for example, ink in four colors of cyan, magenta, yellow, and black can be sprayed onto the sheet P. The ink is stored in an ink cartridge 24.

The ink cartridge 24 is disposed in a front lower portion of the printing apparatus main body 10. An ink supply unit 23 is provided in a front upper portion of the printing apparatus main body 10. The ink in the ink cartridge 24 is supplied to the printing head 40 via the ink supply unit 23. The printing head 40 performs scanning along the carriage guide shafts 41 and 42 disposed in a left-and-right width direction of the printing apparatus 1, and performs printing on the sheet P. Further, a substrate 25 that controls an operation of the printing apparatus 1 is disposed in front of the ink cartridge 24.

The platen 35 of the printing unit 20 has a flat surface disposed along a transport direction F. This flat surface is located below a transport path 110 of the sheet P, and faces the printing head 40. The platen 35 is fixed to the printing apparatus main body 10 of the printing apparatus 1, and supports the sheet P from below. The flat surface of the platen 35 is substantially horizontal in an installation state and a use state of the printing apparatus 1. A transport belt 52 passes over the flat surface of the platen 35. The transport belt 52 is a wide and endless-shaped belt, and is disposed so as to go around to the lower side of the platen 35 from above the flat surface of the platen 35 via a roller 52*a*.

Of a front surface of the transport belt 52, at least a surface facing upward on the flat surface of the platen 35 is a rough surface with a high coefficient of friction. The transport belt 52 may be formed of an elastic material such as rubber and synthetic resin. A drive mechanism (not illustrated) that moves the transport belt 52 is disposed below the platen 35.

A driven roller (not illustrated) is disposed between the printing head 40 and the paper holder 34 so as to face the platen 35.

The driven roller is rotatably supported on the printing apparatus main body 10 of the printing apparatus 1. The driven roller is biased toward the flat surface of the platen 35. In the transport path 110, the sheet P is sandwiched between the driven roller (not illustrated) and the transport belt 52, and is reliably transported in the transport direction F as the transport belt 52 moves.

Further, a holding roller (not illustrated) that holds down the sheet P so as to prevent floating of the sheet P from the transport belt 52 is disposed on the printing head 40. The paper guide 33, the paper holder 34, the transport belt 52, the roller 52*a*, and the mechanism for driving the transport belt 52 constitute a transport unit 30 that transports the sheet P to the printing unit 20.

A cutter unit for cutting the sheet P can be mounted on the front surface of the printing apparatus main body 10. The cutter unit may make a cut while leaving a part of the sheet P in the width direction, or may completely cut the sheet P. The printing apparatus 1 cuts the sheet P printed by the printing head 40 to a predetermined length by the cutter unit, and can discharge the sheet P from the paper exit 22.

A winding unit (not illustrated) can be attached to and detached from the front surface of the printing apparatus main body 10 below the paper exit 22. The winding unit includes a winding drum that winds the sheet P discharged from the paper exit 22, and a drive unit (not illustrated) that rotates the winding drum, and the winding unit can wind the sheet P. A peeler may be attached to the front surface of the printing apparatus main body 10. The peeler can wind release paper while removing a label from the release paper.

The housing portion 21 having an open upper portion is provided in the rear portion of the printing apparatus main body 10. The housing portion 21 is disposed behind the printing unit 20. The paper guide 33 and the paper holder 34 are disposed in the housing portion 21. The housing portion 21 is covered by the cover 60.

According to the present exemplary embodiment, the cover 60 is supported by a front support portion 11 and a rear support portion 12 so as to be freely open and closed in two directions R1 and R2. A rear portion 60*r* of the cover 60 is rotationally moved in the first direction R1 with respect to the front support portion 11, and the cover 60 is rotationally moved to a first open position C1. Further, a front portion 60*f* of the cover 60 is rotationally moved in the second direction R2 with respect to the rear support portion 12, and the cover 60 is rotationally moved to a second open position C2.

Figure 2:
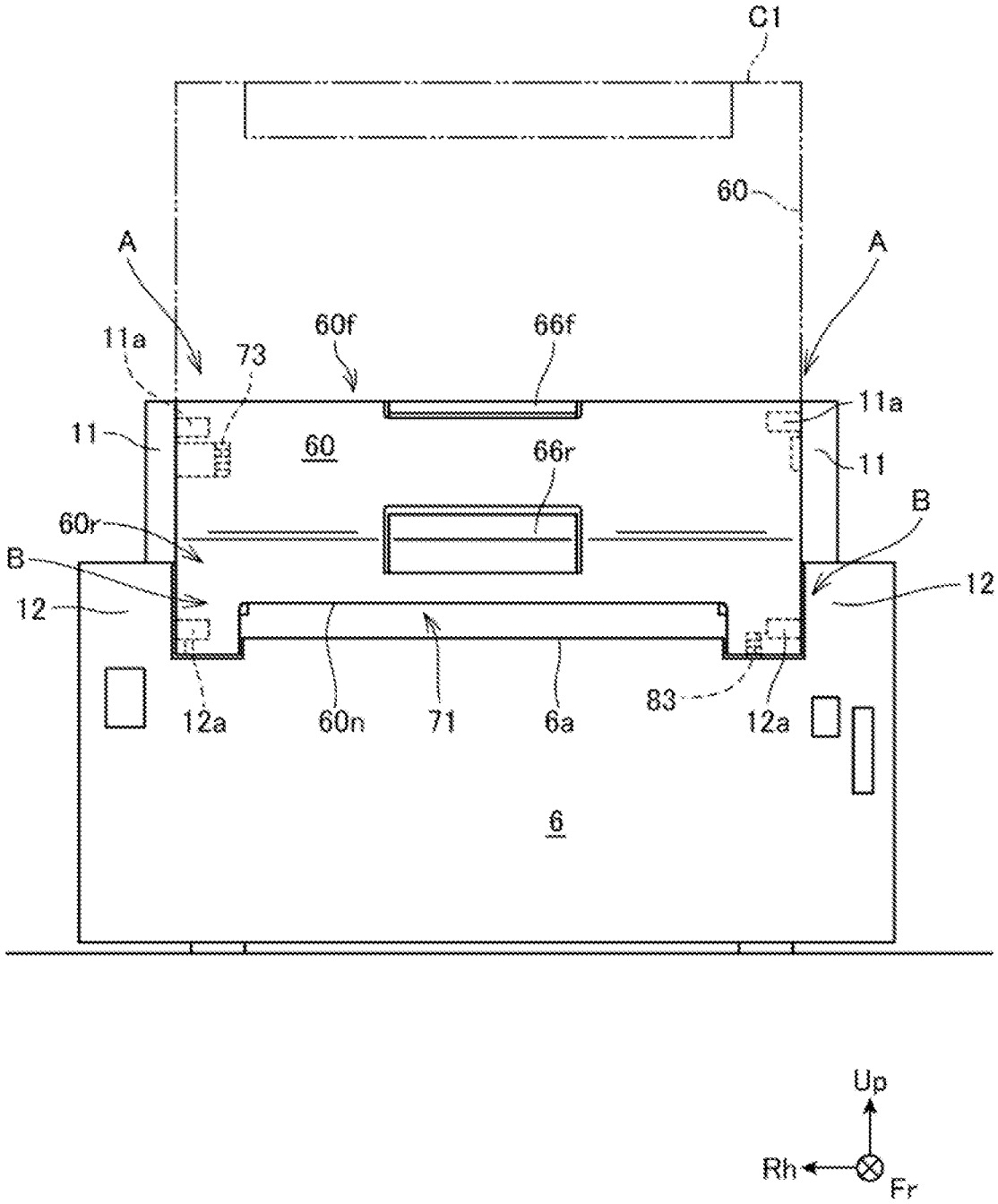
FIG. 2 is a back view of the printing apparatus.

FIG. 2 is a back view of the printing apparatus.

As illustrated in FIG. 2, an insertion opening 71 is formed in a rear surface of the printing apparatus 1 with the cover 60 being closed. The insertion opening 71 is formed between a notch 60*n* provided in a lower portion of the rear portion 60*r* and a rear upper edge 6*a* of an outer packaging 6 of the printing apparatus 1. The insertion opening 71 is formed in an upper portion of a rear end of the housing portion 21.

As illustrated in FIG. 1, the fanfold paper 101 passes through the insertion opening 71 that communicates with the housing portion 21, and is supplied to the inside of the printing apparatus 1.

The notch 60*n* is formed open to a position exceeding a height of a second support shaft 12*a*, which will be described later, in a closed position C0 in which the cover 60 illustrated in FIG. 1 is closed. In this way, with the cover 60 being open to the second open position C2, the insertion opening 71 is formed between the notch 60*n* and the outer packaging 6. Therefore, even when the cover 60 is located in the second open position C2, the insertion opening 71 is exposed to the rear, and thus the sheet P can pass through the insertion port 71 and the printing apparatus 1 can be loaded with the fanfold paper 101.

Further, the rear portion 60*r* of the cover 60 is rotationally moved in the first direction R1 with respect to the front support portion 11, and the cover 60 is rotationally moved to the first open position C1. When the cover 60 is rotationally moved to the first open position C1, the housing portion 21 and an opening surrounded by the cover 60 in the first open position C1 open greatly toward the rear of the printing apparatus 1. In this way, even when the cover 60 is located in the first open position C1, the fanfold paper 101 disposed behind the printing apparatus 1 can be more easily loaded from the rear of the printing apparatus 1.

Figure 3:
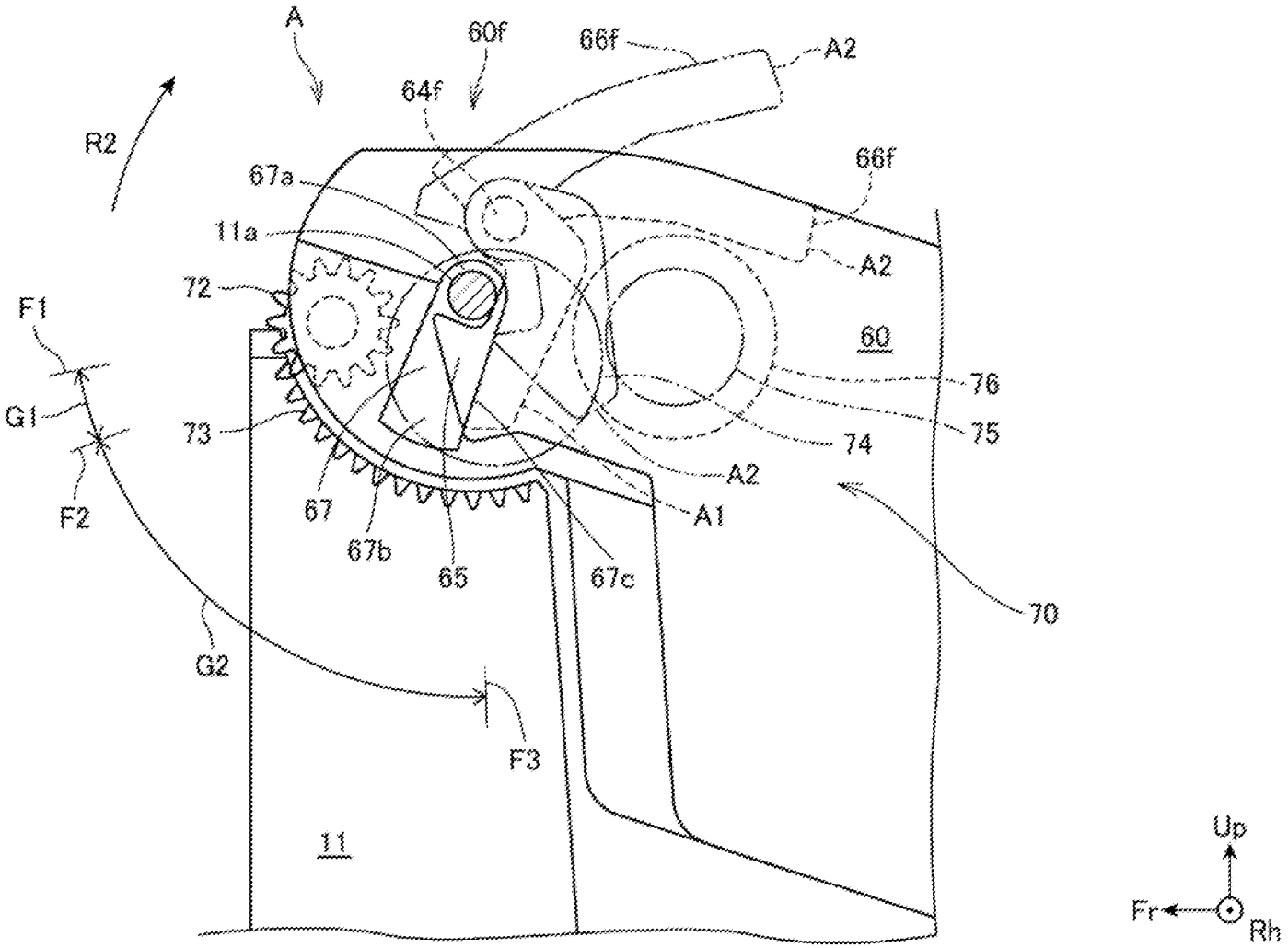
FIG. 3 is a side view of a main portion illustrating an engagement mechanism of a front support portion and a cover front portion.

FIG. 3 is a side view of a main portion illustrating an engagement mechanism A of the front support portion 11 and the front portion 60*f* of the cover 60. The front portion 60*f* of the cover 60 is disposed between the front support portions 11 provided on left and right side portions of the printing apparatus main body 10. A first support shaft 11*a* that extends toward the cover 60 is provided on each of the left and right front support portions 11. Each of the left and right first support shafts 11*a* together with the second support shaft 12*a*, which will be described later, constitute a support shaft portion 60*a* that rotatably supports the cover 60.

When the front portion 60*f* of the cover 60 is opened, engagement between the engagement mechanism A and the first support shaft 11*a* is released, and the front portion 60*f* is separated from the front support portion 11.

The first support shaft 11*a* is a short pin protruding toward the cover 60. An extension direction of the first support shaft 11*a* coincides with the left-and-right direction of the printing apparatus 1.

The engagement mechanism A is constituted by a first hook member 65 that engages with the first support shaft 11*a*, a front rod 64*f* that is a rotational movement shaft of the first hook member 65, and a front lever 66*f* that releases the engagement. The first hook members 65 provided on the left and right of the front portion 60*f* of the cover 60 are fixed to left and right end portions of the front rod 64*f* so as to be relatively rotationally immovable.

The front lever 66*f* is fixed to the center of the front rod 64*f*, and the front lever 66*f* is rotatably supported on the cover 60 with the front rod 64*f* as a rotational movement shaft.

With the cover 60 illustrated in FIG. 1 in the closed position C0, the first support shaft 11*a* fits into a guide groove 67 provided on each of left and right side surfaces of the front portion 60*f*, and is engaged by the first hook member 65. The first hook member 65 is configured to have a hook shape in which a tip portion is curved in a rotational movement direction. The first hook member 65 is movable between an engagement position A1 and a release position A2.

The first hook member 65 is biased by a biasing member (not illustrated) so as to move from the release position A2 to the engagement position A1.

The guide groove 67 is provided obliquely downward on a partway portion in a thickness direction of the front portion 60*f* in a closed state of the cover 60.

When the front portion 60*f* of the cover 60 is closed, the first support shaft 11*a* is introduced into the guide groove 67 from a lower end portion 67*b* of the guide groove 67. Then, the first support shaft 11*a* abuts the first hook member 65, and rotationally moves the first hook member 65 toward the release position A2. When the first support shaft 11*a* reaches an upper end portion 67*a* of the guide groove 67, the first hook member 65 returns to the engagement position A1. Then, the first support shaft 11*a* is held between the upper end portion 67*a* of the guide groove 67 and the first hook member 65. In this way, the engagement mechanism A and the first support shaft 11*a* engage with each other.

In the engagement position A1, the first hook member 65 protrudes from a rear surface 67*c* of the guide groove 67 toward the guide groove 67. In the guide groove 67, the first hook member 65 is configured to have a shape in which the amount of protrusion into the guide groove 67 is reduced toward the lower end portion 67*b* of the guide groove 67.

When the front portion 60*f* of the cover 60 is closed, the front portion 60*f* is rotationally moved downward around the second support shaft 12*a* illustrated in FIG. 2. In this way, the first support shaft 11*a* is introduced into the guide groove 67, and the first support shaft 11*a* pushes and rotationally moves the first hook member 65. Then, when the first support shaft 11*a* reaches the upper end portion 67*a* of the guide groove 67, the first hook member 65 protrudes into the guide groove 67, and the first support shaft 11*a* is locked by the first hook member 65 and the guide groove 67.

When the cover 60 opens from the front portion 60*f*, the locking of the first support shaft 11*a* is released. At this time, the front lever 66*f* is rotationally moved upward around the front rod 64*f*. In this way, the front lever 66*f* and the first hook member 65 move to the release position A2.

Then, the first hook member 65 retracts from the inside of the guide groove 67. In this way, the locking of the first support shaft 11*a* is released, and the front portion 60*f* of the cover 60 can rotationally move in the second direction R2 with the first support shaft 11*a* fitted in the guide groove 67.

In the present exemplary embodiment, a buffering mechanism 70 as a gear wheel train that buffers a rotational movement around the front portion 60*f* is provided around the first support shaft 11*a*. The buffering mechanism 70 is constituted by a first internal gear 73 provided on an upper end portion of the front support portion 11 of the printing apparatus 1, a first spur gear 72 provided on the front portion 60*f* of the cover 60, an intermediate gear 74, a first damper 76, and a damper gear 75 attached to a rotary shaft of the first damper 76.

The first spur gear 72 is rotatably supported by the cover 60. A rotational movement shaft of the first spur gear 72 coincides with the left-and-right direction of the printing apparatus 1. The intermediate gear 74 meshing with the first spur gear 72 transmits the rotation of the first spur gear 72 to the first damper 76 via the damper gear 75. For example, a rotary damper using a flow resistance or a rotary damper using a frictional resistance can be used as the first damper 76. The first internal gear 73 is a peripheral portion of the first support shaft 11*a*, and is provided on a circumferential portion. The first internal gear 73 is formed on an arc centered around the first support shaft 11*a* on the upper end portion of the front support portion 11.

The first spur gear 72 is disposed such that a part of the first spur gear 72 protrudes forward with respect to the front portion 60*f* with the cover 60 in the closed position C0.

When the cover 60 rotationally moves at equal to or greater than a predetermined angle around the first support shaft 11*a*, the first spur gear 72 meshes with the first internal gear 73, and the first spur gear 72 rotates. Then, the first damper 76 applies a load to the rotation of the first spur gear 72 and buffers the rotational movement of the cover 60. The predetermined angle is appropriately set by a shape of the cover 60.

In the buffer mechanism 70 of the front portion 60*f*, a range in which the first spur gear 72 and the first internal gear 73 do not mesh with each other is provided. A straight line F1 is a straight line passing through the rotation center of the first spur gear 72 and the first support shaft 11*a* with the cover 60 in the closed position C0. A straight line F2 is a straight line passing through the rotation center of the first spur gear 72 and the first support shaft 11*a* in a state in which the first spur gear 72 starts to contact the first internal gear 73. A straight line F3 is a straight line passing through the rotation center of the first spur gear 72 and the first support shaft 11*a* with the cover 60 in the second open position C2.

In a rotational movement range G1 from the straight line F1 to the straight line F2, the first spur gear 72 does not contact the first internal gear 73, and the first damper 76 does not operate. An angle of the rotational movement range G1 is a predetermined angle G1 at which the first spur gear 72 and the first internal gear 73 do not contact each other. Further, the rotational movement range G1 may be set to be a range from the closed position C0 of the cover 60 to a rotational movement position in which the second support shaft 12*a* and a second hook member 68 contact each other. In this way, when the cover 60 changes its posture due to contact with the second support shaft 12*a*, a load is less likely to be applied to the first spur gear 72 and the first internal gear 73.

In a rotational movement range G2 from the straight line F2 to the straight line F3, the first spur gear 72 contacts the first internal gear 73, and the first damper 76 operates. In such a manner, the rotational movement range G1 in which the first damper 76 does not operate and the rotational movement range G2 in which the first damper 76 operates are sequentially provided between the closed position C0 of the cover 60 and the second open position C2.

Figure 4:
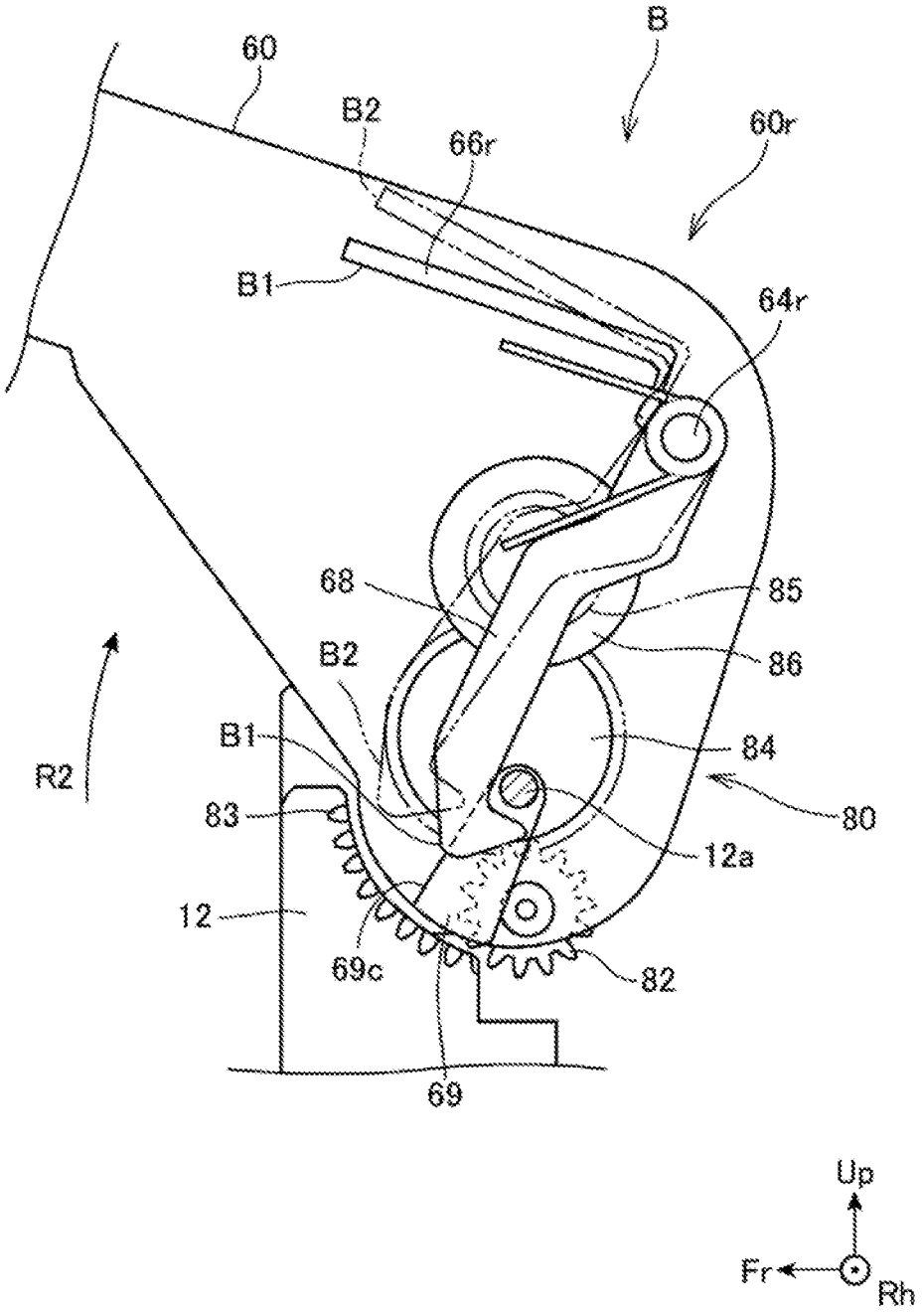
FIG. 4 is a side view of a main portion illustrating an engagement mechanism of a rear support portion and a cover rear portion.

FIG. 4 is a side view of a main portion illustrating an engagement mechanism B of the rear support portion 12 and the rear portion 60*r* of the cover 60. The engagement mechanism B is constituted by the second hook member 68, a rear rod 64*r* that is a rotational movement shaft of the second hook member 68, and a rear lever 66*r* that integrally rotationally moves with the second hook member 68. The second hook member 68 is fixed to the rear rod 64*r*. The second hook members 68 are fixed to left and right end portions of the rear rod 64*r* so as to be relatively rotationally immovable. Further, the rear lever 66*r* is fixed to a central portion of the rear rod 64*r*. The rear lever 66*r* is rotatably supported on the cover 60 with the rear rod 64*r* as a rotational movement shaft.

The rear portion 60*r* of the cover 60 is disposed between the rear support portions 12 provided on the left and right side portions of the printing apparatus 1. The second support shaft 12*a* that extends toward the cover 60 is provided on the rear support portion 12. Each of the left and right second support shaft 12*a* together with the first support shaft 11*a* constitute the support shaft portion 60*a* that rotatably supports the cover 60. The second support shaft 12*a* is a short pin protruding toward the cover 60. Then, an extension direction of the second support shaft 12*a* coincides with the left-and-right direction of the printing apparatus 1.

When the rear portion 60*r* of the cover 60 is opened, engagement between the engagement mechanism B and the second support shaft 12*a* is released, and the rear portion 60*r* is separated from the rear support portion 12.

With the cover 60 in the closed position C0, the second support shaft 12*a* fits into a guide groove 69 provided in the cover 60 and is locked by the second hook member 68.

The guide groove 69 is provided in left and right side surfaces of the rear portion 60*r* of the cover 60. The guide groove 69 is provided obliquely downward on a lower end portion of the rear portion 60*r* in the closed state of the cover 60. A lower end portion 69*b* of the guide groove 69 opens downward. When the cover 60 is closed, the second support shaft 12*a* is introduced into the guide groove 69 from the lower end portion 69*b* of the guide groove 69. The second support shaft 12*a* is locked by an upper end portion 69*a* of the guide groove 69 and the second hook member 68.

The second hook member 68 is configured to have a hook shape in which a tip portion is curved in a rotational movement direction. The second hook member 68 is movable between an engagement position B1 and a release position B2. The second hook member 68 is biased by a spring 68*a* so as to be rotationally moved from the release position B2 to the engagement position B1.

The second hook member 68 protrudes into the guide groove 69 from a front surface 69*c* of the guide groove 69. The portion of the second hook member 68 protruding into the guide groove 69 is configured such that the amount of protrusion into the guide groove 69 is reduced toward the lower end portion 69*b* of the guide groove 69.

In this way, when the rear portion 60*r* of the cover 60 is closed, the second support shaft 12*a* is introduced into the guide groove 69 and pushes the second hook member 68, and thus rotationally moves the second hook member 68 from the engagement position B1 to the release position B2.

Then, when the second support shaft 12*a* reaches the upper end portion 69*a* of the guide groove 69, the second hook member 68 protrudes into the guide groove 69, and the second support shaft 12*a* is locked by the second hook member 68 and the guide groove 69.

When the rear portion 60*r* of the cover 60 is opened, the locking of the second support shaft 12*a* is released. By rotationally moving the rear lever 66*r* upward, the second hook member 68 retracts from the inside of the guide groove 69, and moves from the engagement position B1 to the release position B2. In this way, the locking of the second support shaft 12*a* is released, and the second support shaft 12*a* is movable within the guide groove 69.

In the present exemplary embodiment, a buffering mechanism 80 configured as a gear wheel train that buffers a rotational movement around the rear portion 60*r* is provided.

The buffering mechanism 80 is constituted by a second internal gear 83 and a second spur gear 82 that are provided on an upper end portion of the rear support portion 12, an intermediate gear 84, a second damper 86, and a damper gear 85 that rotationally moves integrally with a rotational movement shaft of the second damper 86.

The second spur gear 82, the intermediate gear 84, and the second damper 86 are provided on the rear portion 60*r* of the cover 60. The second internal gear 83 is a peripheral portion of the second support shaft 12*a*, and is provided on a circumferential portion. The second internal gear 83 is formed on an arc centered around the second support shaft 12*a* on the upper end portion of the rear support portion 12.

The second spur gear 82 is rotatably supported by the rear portion 60*r* of the cover 60. A rotational movement shaft of the second spur gear 82 coincides with the left-and-right direction of the printing apparatus 1. The intermediate gear 84 meshing with the second spur gear 82 transmits the rotation of the second spur gear 82 to the second damper 86. Then, the second damper 86 buffers the rotational movement of the second spur gear 82.

The second spur gear 82 is disposed such that a part thereof protrudes downward with respect to the rear portion 60*r*. Then, when the cover 60 rotationally moves at equal to or greater than a predetermined angle around the second support shaft 12*a*, the second spur gear 82 meshes with the second internal gear 83, and the second spur gear 82 rotates. Then, the second damper 86 applies a load to the rotation of the second spur gear 82, and buffers the rotational movement of the cover 60. Further, the rotational movement by an empty weight of the cover 60 can be prevented by setting of the second damper 86. The predetermined angle is appropriately set by a shape of the cover 60.

Next, an operation of the buffering mechanisms 70 and 80 will be described.

Figure 5:
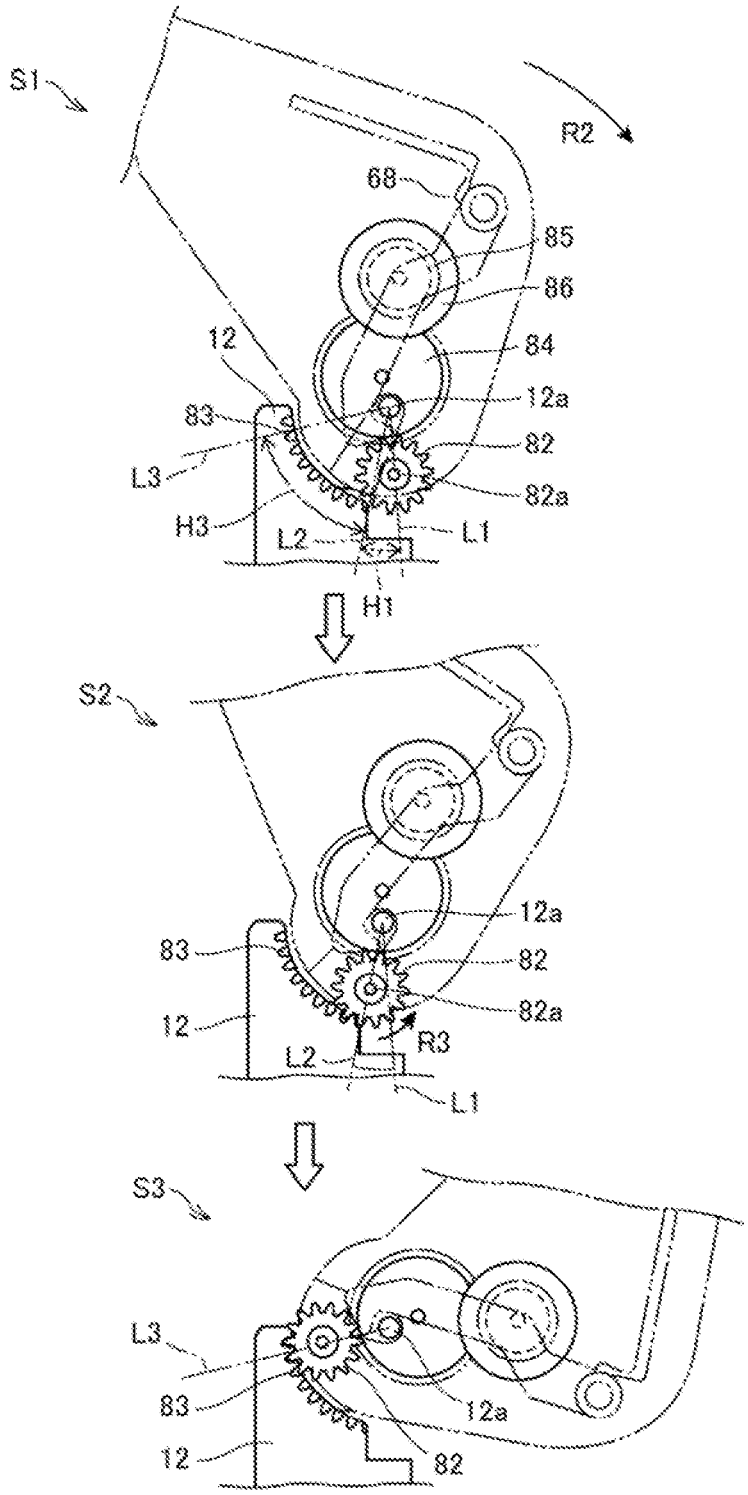
FIG. 5 is an explanatory diagram illustrating an operation of a buffering mechanism of the cover rear portion.

FIG. 5 is an explanatory diagram illustrating the operation of the buffering mechanism 80 of the rear portion 60*r* of the cover 60. In FIG. 5, a state S1 indicates a state in which the cover 60 is closed.

In this state S1, the second spur gear 82 and the second internal gear 83 do not mesh with each other, and the second damper 86 of the rear portion 60*r* is not in operation. An angle of a rotational movement range H1 is a predetermined angle H1 at which the second spur gear 82 and the second internal gear 83 do not contact each other.

A state S2 indicates a state in which the front portion 60*f* of the cover 60 is rotationally moved upward, and the second spur gear 82 and the second internal gear 83 start to mesh with each other. When the second spur gear 82 and the second internal gear 83 start to mesh with each other, the second damper 86 starts to operate.

A state S3 indicates a state in which a maximum rotational movement state to the rear of the cover 60. The state S3 indicates a state in which the cover 60 is opened to the second, open position C2. In the state S3, the rotational movement of the cover 60 into the second direction R2 is regulated by a stopper (not illustrated). A straight line L1 is a straight line that connects the second support shaft 12*a* and a rotary shaft 82*a* of the second spur gear 82 in the state S1. A straight line L2 is a straight line that connects the second support shaft 12*a* and the rotary shaft 82*a* in the state S2. A straight line L3 is a straight line that connects the second support shaft 12*a* and the rotary shaft 82*a* in the state S3.

The cover 60 is rotationally moved from the state S1 to the state S3 with the second support shaft 12*a* as a rotational movement center. In a range from the state S1 to the state S3, a range in which the second damper 86 does not work is provided. In the rotational movement range H1 of the cover 60 from the state S1 to the state S2, the second spur gear 82 does not contact the second internal gear 83.

Then, in a rotational movement range H2 of the cover 60 from the state S2 to the state S3, the second spur gear 82 contacts the second internal gear 83.

In the rotational movement range H1, the second spur gear 82 and the second internal gear 83 do not mesh with each other. Thus, in the rotational movement range H1, the second damper 86 does not operate.

When the cover 60 is opened with the second support shaft 12*a* as the rotational movement center, the front lever 66*f* of the front portion 60*f* is lifted. The front lever 66*f* is lifted, and the engagement between the engagement mechanism A and the first support shaft 11*a* is released. The front portion 60*f* rotationally moves in the second direction R2. The second damper 86 does not operate until the engagement with the first support shaft 11*a* is sufficiently released, and thus an operation in the rotational movement range H1 for opening the front portion 60*f* can be performed smoothly.

In the rotational movement range H2, the second spur gear 82 meshes with the second internal gear 83. At this time, the second spur gear 82 meshes with the second internal gear 83 while rotating in the rotation direction R3.

In this way, the second spur gear 82 is rotationally moved by the rotational movement of the cover 60, and a driving force is transmitted to the second damper 86 via the intermediate gear 84 and the damper gear 85. Then, the second damper 86 operates, and a load is applied to the rotational movement of the cover 60. Thus, when the cover 60 is rotationally moved in the rotational movement range H2, the behavior of the cover 60 during the rotational movement is stabilized by the second damper 86. Further, sudden opening and closing of the cover 60 are suppressed.

When the cover 60 is closed with the second support shaft 12*a* as the rotational movement center, a state in which the second damper 86 operates in the rotational movement range H2 changes to a state in which the second damper 86 does not operate in the rotational movement range H1, and the first support shaft 11*a* can easily engage with the cover 60. In this way, the cover 60 can be reliably closed. Further, the front portion 60*f* of the cover 60 can be closed by using an empty weight of the cover 60. The rotational movement range H1 may be set to be a range from the closed position C0 of the cover 60 to a rotational movement position in which the first support shaft 11*a* and the first hook member 65 contact each other. In this way, when the cover 60 changes its posture due to contact with the first support shaft 11*a*, a load is less likely to be applied to the second spur gear 82 and the second internal gear 83.

In the present exemplary embodiment, immediately before the cover 60 reaches the closed position C0 from the open state, the second spur gear 82 is configured to escape to the outside of the second internal gear 83 such that the second spur gear 82 does not mesh with the second internal gear 83, as illustrated in the state S1 in FIG. 5. Therefore, in the present exemplary embodiment, locking of the second spur gear 82 can be prevented as compared to when the cover 60 reaches the closed position C0 while the second spur gear 82 and the second internal gear 83 mesh with each other.

A resistance of the second damper 86 can be arbitrarily set, and the second damper 86 can also limit the rotational movement due to an empty weight of the cover 60. In this case, the cover 60 can be held in any position between the state S2 and the state S3.

Next, the operation of the buffer mechanism 70 of the front portion 60*f* illustrated in FIG. 3 will be described.

The operation of the buffer mechanism 70 is almost the same as the operation of the buffer mechanism 80. The rear portion 60*r* of the cover 60 is rotationally moved from the closed state in FIG. 3 with respect to the front support portion 11 in the first direction R1, and the cover 60 is rotationally moved to the first open position C1, as illustrated in FIG. 1.

The state in FIG. 3 is a state in which the first spur gear 72 and the first internal gear 73 do not mesh with each other, and the buffering mechanism 70 is not in operation. When the cover 60 starts to gradually rotationally move in the first direction R1 from the closed state in FIG. 3, the first spur gear 72 and the first internal gear 73 start to mesh with each other, and the first damper 76 gradually starts to operate similarly to the operation of the buffering mechanism 80 described above. When the cover 60 reaches the first open position C1, which is the maximum rotational movement state to the front, the rotational movement of the cover 60 into the first direction R1 is regulated by a stopper (not illustrated).

The rotational movement range G1 is a range in which the first spur gear 72 does not contact the first internal gear 73, and the first damper 76 does not operate. The rotational movement range G2 is a range in which the first spur gear 72 contacts the first internal gear 73, and the first damper 76 operates. In this way, in the buffer mechanism 70 of the front portion 60*f* of the cover 60, the rotational movement range G1 in which the first damper 76 does not operate and the rotational movement range G2 in which the first damper 76 operates are also provided similarly to the buffering mechanism 80.

In the present exemplary embodiment, immediately before the cover 60 reaches the closed position C0 from the open state, the first spur gear 72 is configured to escape to the outside of the first internal gear 73 such that the first spur gear 72 does not mesh with the first internal gear 73, as illustrated in FIG. 3. Therefore, in the present exemplary embodiment, locking of the first spur gear 72 can be prevented as compared to when the cover 60 reaches the closed position C0 while the first spur gear 72 and the first internal gear 73 mesh with each other.

A resistance of the first damper 76 can be arbitrarily set, and the first damper 76 can also limit the rotational movement due to an empty weight of the cover 60.

Figure 6:
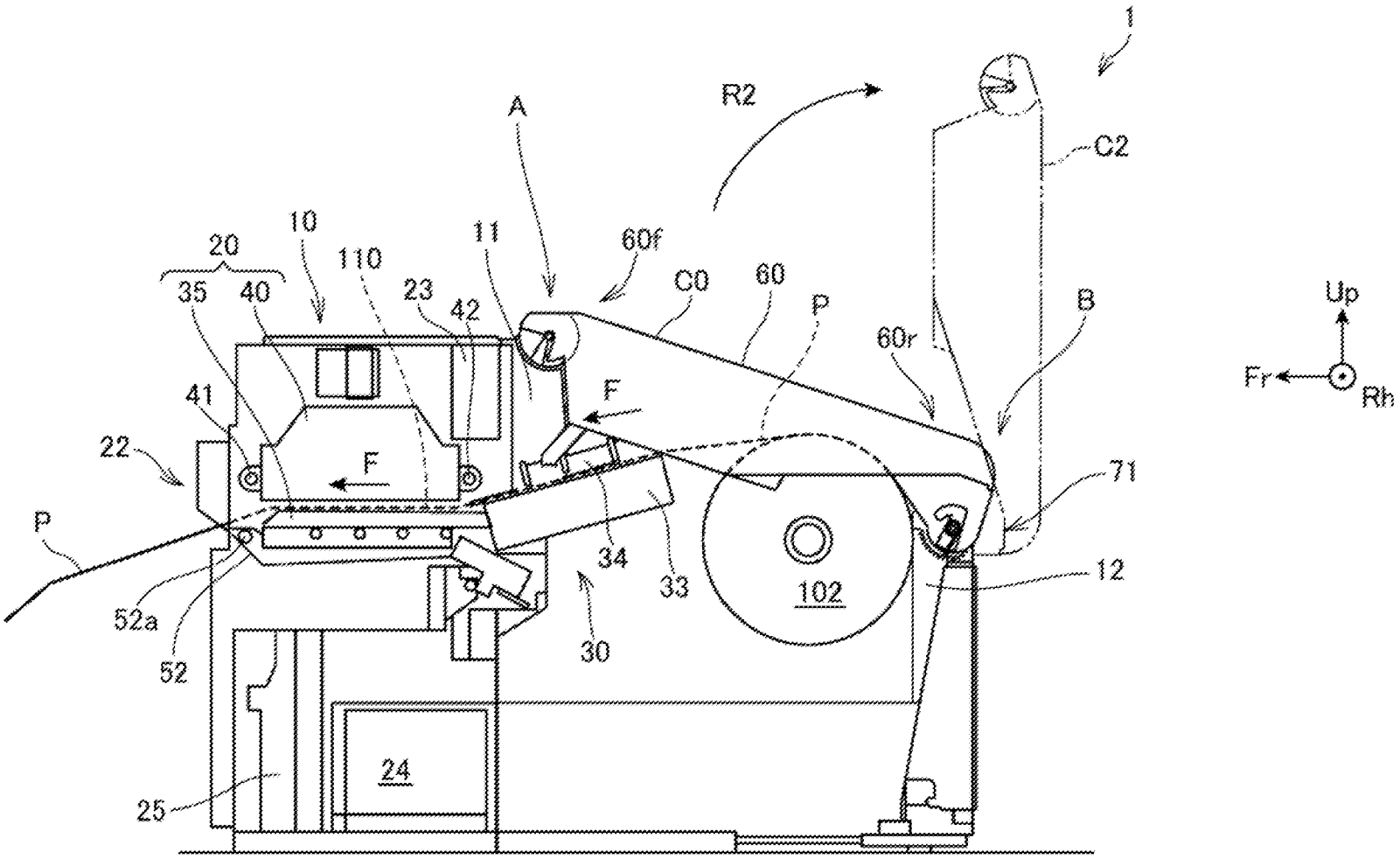
FIG. 6 is a side view illustrating an internal structure of the printing apparatus loaded with roll paper.

FIG. 6 illustrates a state in which roll paper 102 is loaded. The same portion as that in FIG. 1 is denoted by the same reference sign, and description thereof will be omitted.

In the present exemplary embodiment, when the roll paper is loaded from the front of the printing apparatus 1, the front portion 60*f* of the cover 60 is rotationally moved in the second direction R2, and the housing portion 21 is opened. The roll paper 102 is disposed in the opened housing portion 21. One end of the disposed roll paper 102 is pulled out and loaded between the paper guide 33 and the paper holder 34. Then, the sheet P is introduced into the printing unit 20, and the cover 60 is closed. When work is conducted from the front of the printing apparatus 1, the front portion 60*f* of the cover 60 is opened to the second open position C2, and thus a great work space close to the front of the printing apparatus 1 is secured.

In the present exemplary embodiment, the rear portion 60*r* of the cover 60 may be opened to the first open position C1 illustrated in FIG. 1, and the roll paper 102 may be loaded from the rear of the printing apparatus 1.

In the printing apparatus 1 according to the present exemplary embodiment, the front portion 60*f* or the rear portion 60*r* of the cover 60 is opened, and thus fanfold paper and roll paper can be loaded from the front and rear of the printing apparatus 1 along the transport direction F of the sheet P. Therefore, a degree of freedom in the arrangement of the printing apparatus 1 is less likely to be limited for loading work of the sheet P.

Next, a sheet guide mechanism 90 will be described.

Figure 7:
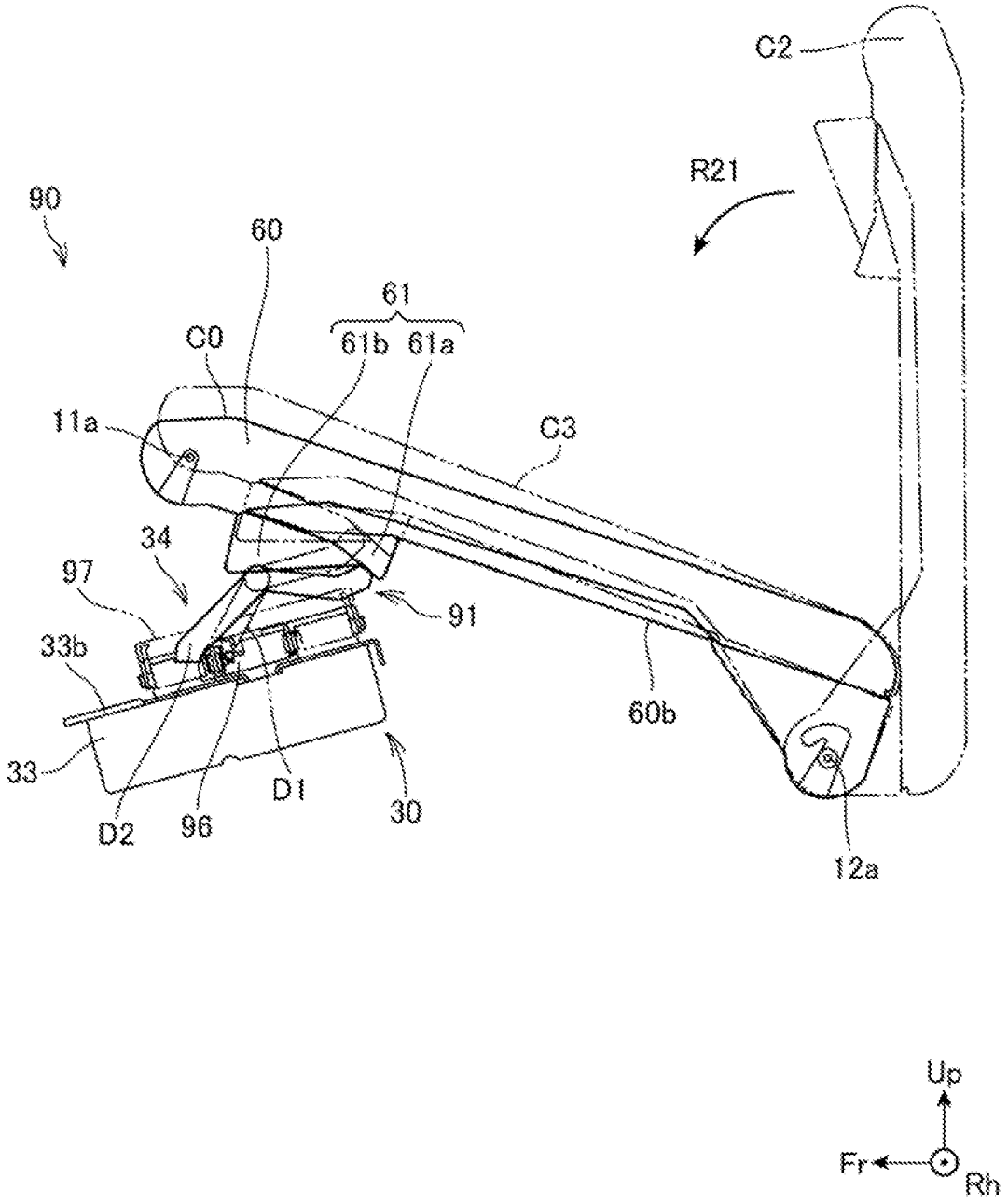
FIG. 7 is a side view illustrating a sheet guide mechanism.
Figure 8:
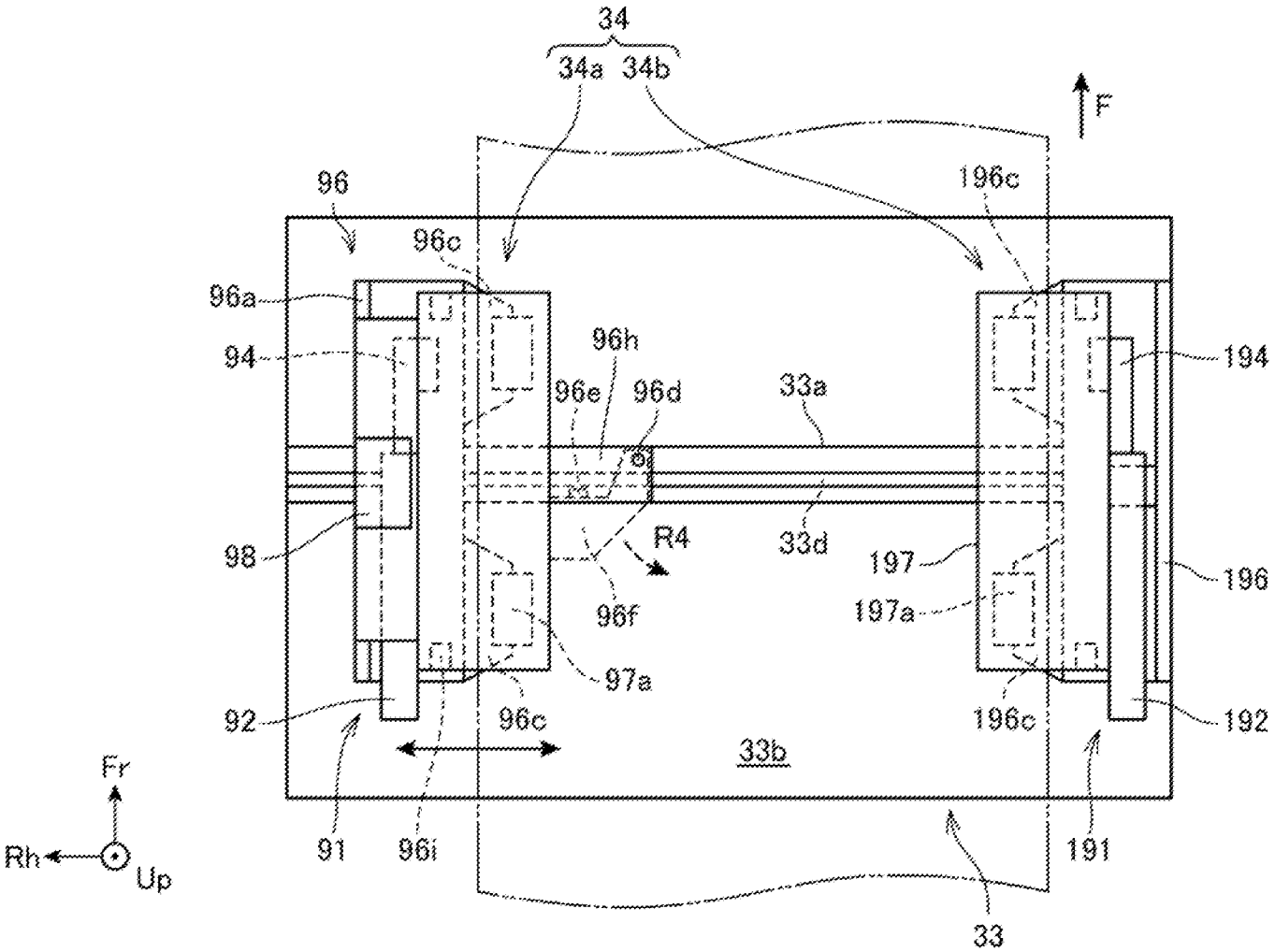
FIG. 8 is a plan view illustrating the sheet guide mechanism.

FIG. 7 is a side view illustrating the sheet guide mechanism 90. FIG. 8 is a plan view illustrating the sheet guide mechanism 90.

The sheet guide mechanism 90 guides the sheet P in the transport unit 30. The sheet guide mechanism 90 includes the paper holder 34 provided on a guide surface 33*b* of the paper guide 33 and the cover 60. The pair of paper holders 34 are disposed on the guide surface 33*b* so as to be spaced from each other in a direction intersecting the transport direction F. These are referred to as a right paper holder 34*a* and a left paper holder 34*b*.

The paper holders 34 transport the sheet P while a right-side end portion and a left-side end portion of the sheet P are supported by the right paper holder 34*a* and the left paper holder 34*b*, respectively. This configuration can regulate floating of the sheet P during transport and stably transport the sheet P.

The left paper holder 34*b* is fixed to a left end portion on the guide surface 33*b*. The right paper holder 34*a* is provided so as to be movable in the direction intersecting the transport direction F along the guide surface 33*b*.

As described later, the right paper holder 34*a* includes a reception portion 96 and a guide portion 97 that sandwich the sheet P therebetween, and the left paper holder 34*b* includes a reception portion 196 and a guide portion 197 that sandwich the sheet P therebetween. The sheet P is transported in the transport direction F while both the left and right-side end portions are supported by the right paper holder 34*a* and the left paper holder 34*b*, respectively.

A guide opening 33*a* extending in the direction intersecting the transport direction F is formed in the guide surface 33*b*. The guide opening 33*a* is a groove punched in the guide surface 33*b*, and, in the example illustrated in FIG. 8, the guide opening 33*a* is orthogonal to the transport direction F and extends in the left-and-right direction of the printing apparatus main body 10.

The left paper holder 34*b* is fixed to a left end of the guide opening 33*a*.

The right paper holder 34*a* includes a box portion 96*h*. The box portion 96*h* includes a locking shaft 96*d* that protrudes downward from the right holder 34*a* and a locking plate 96*f* attached to a lower end of the locking shaft 96*d*, and the locking plate 96*f* is fitted in the guide opening 33*a*. A rail 33*d* is disposed in the guide opening 33*a*, and the locking plate 96*f* is located below the rail 33*d*.

A friction body 96*e* is attached to the locking plate 96*f*. The locking plate 96*f* is biased in a direction in which the friction body 96*e* is pressed against the rail 33*d* by a biasing member (not illustrated). In this state, the locking plate 96*f* is fixed to the rail 33*d* by friction between the friction body 96*e* and the rail 33*d*.

A release lever 98 is provided on the right paper holder 34*a*. The release lever 98 is coupled to the locking plate 96*f* by a link (not illustrated), and, when the release lever 98 is pressed and operated, the locking plate 96*f* rotationally moves around the locking shaft 96*d* in a direction indicated by a reference sign R4 in the diagram. In this way, the friction body 96*e* is separated from the rail 33*d*, and fixing of the locking plate 96*f* is released.

The right paper holder 34*a* is movable along the guide opening 33*a*, and is fixed by friction between the friction body 96*e* and the rail 33*d* while the release lever 98 is not pressed. When the release lever 98 is pressed, the right paper holder 34*a* is movable along the guide opening 33*a*. In this way, the right paper holder 34*a* is movable along the guide opening 33*a* in accordance with a position of the side end portion of the sheet P, and thus the printing apparatus 1 can support the sheet P having various widths by the paper holder 34.

Next, a configuration and action of the paper holder 34 for sandwiching the sheet P will be described. The right paper holder 34*a* and the left paper holder 34*b* are configured to be left-right symmetrical except for the fixed state to the guide opening 33*a*. Thus, the right paper holder 34*a* is used for the following description.

Figure 9:
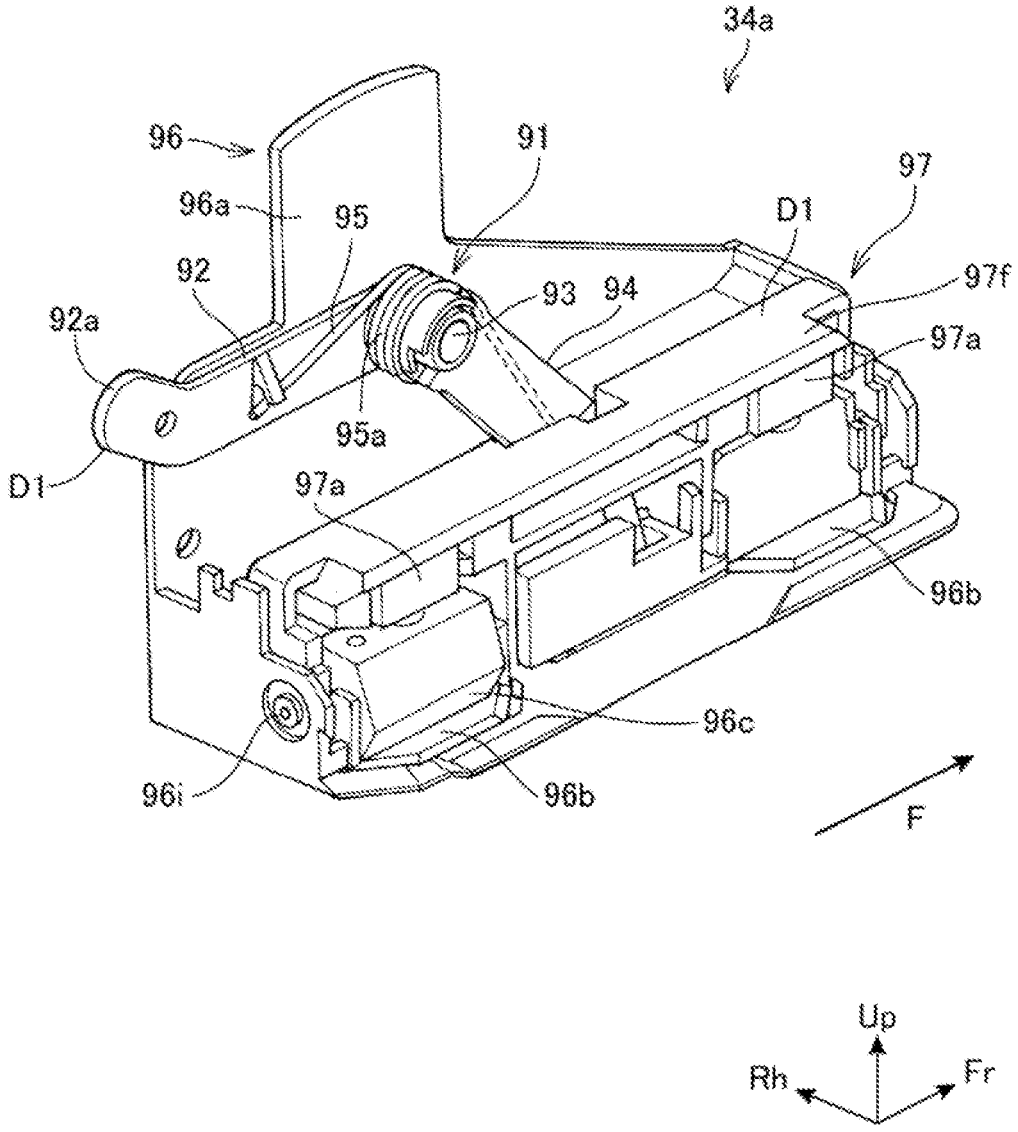
FIG. 9 is a perspective view illustrating a paper holder.
Figure 10:
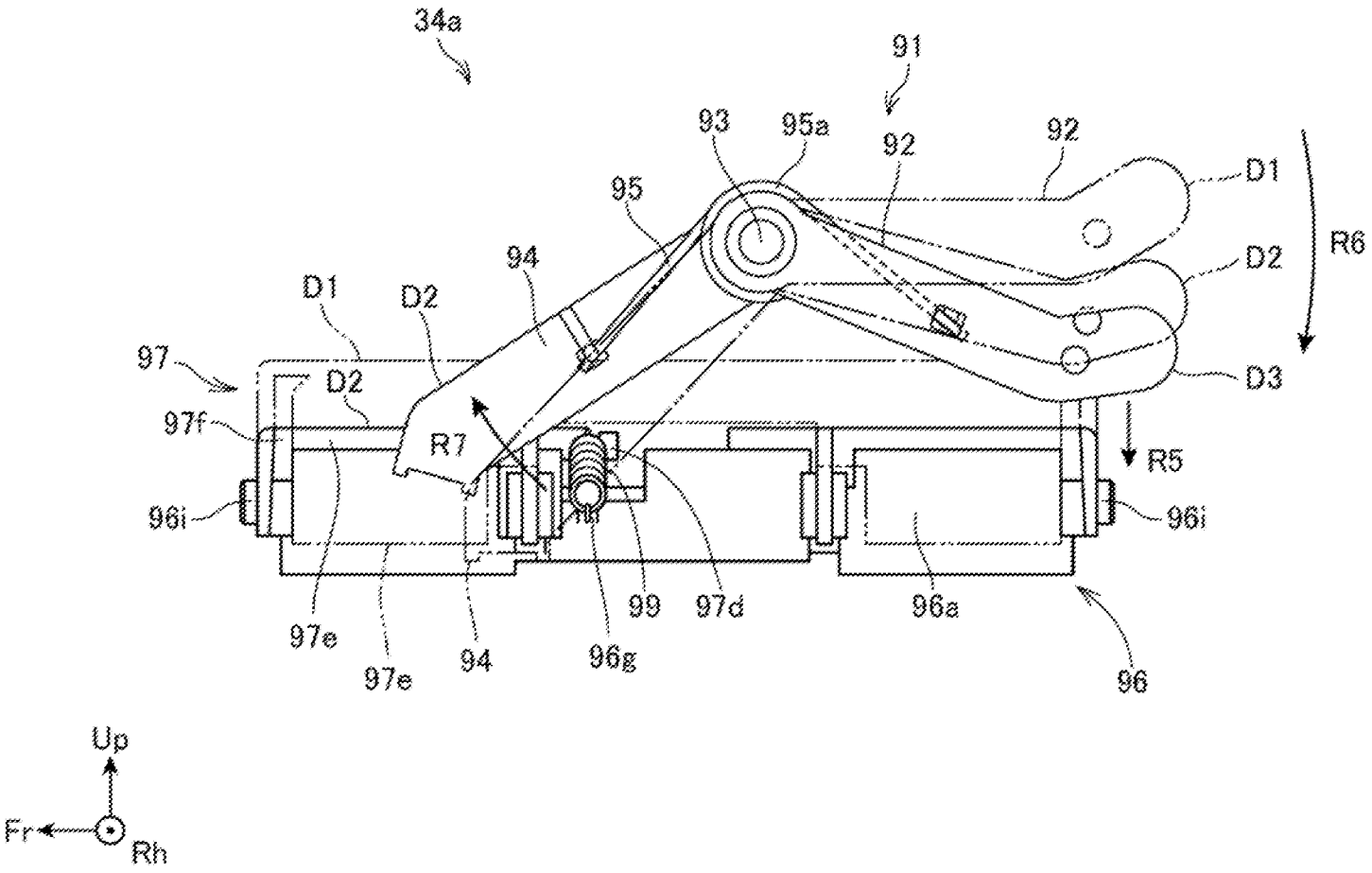
FIG. 10 is a side view of a main portion of the paper holder.
Figure 11:
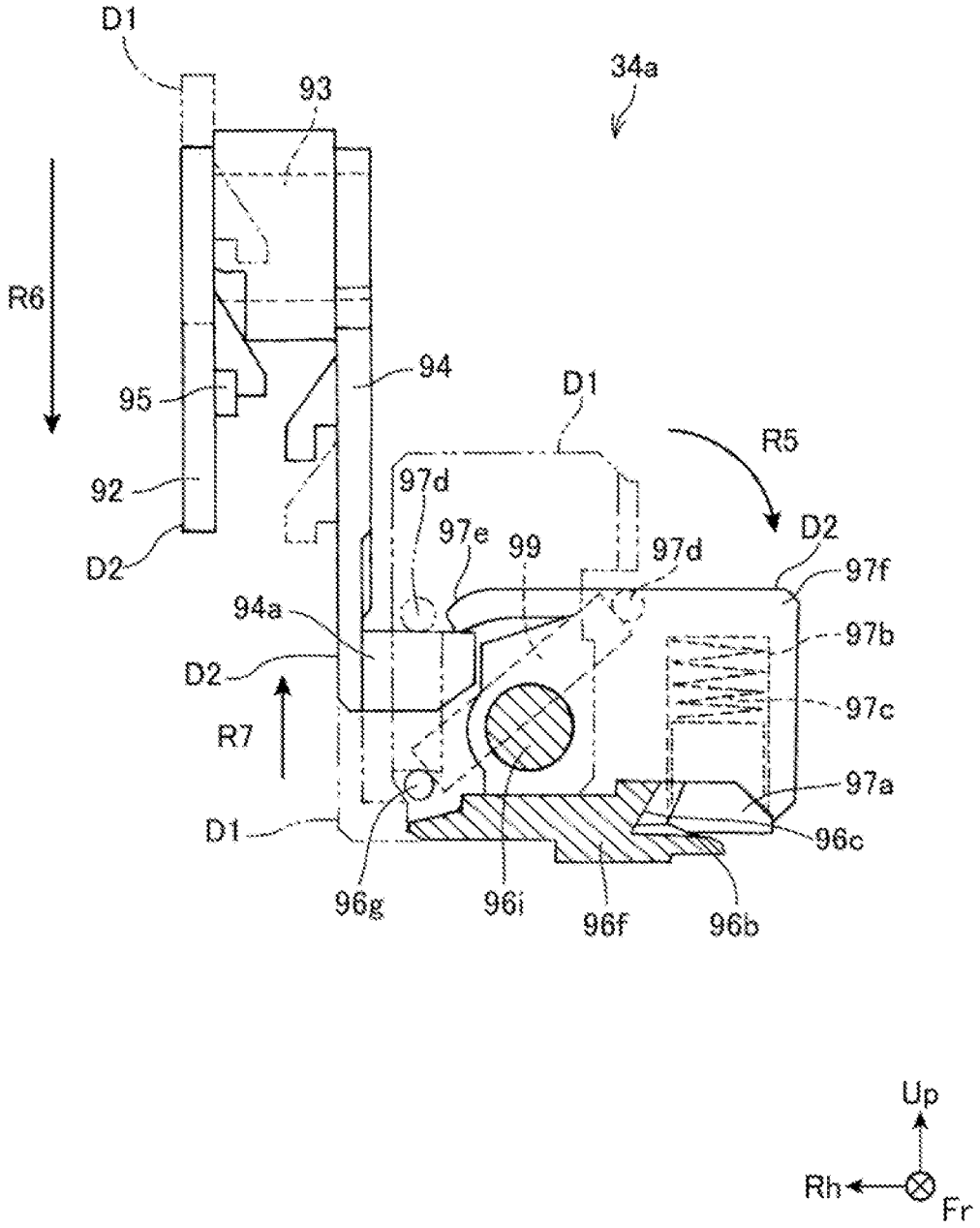
FIG. 11 is a rear view of the main portion of the paper holder.

FIG. 9 is a perspective view illustrating the right paper holder 34*a*. FIG. 10 is a side view of a main portion of the right paper holder 34*a*. FIG. 11 is a rear view of the main portion of the right paper holder 34*a*.

FIGS. 9, 10, and 11 illustrate an open position D1, a guide position D2, and a pressing-in position D3 as positions of each unit of the right paper holder 34*a*.

The open position D1 indicates a state in which the sheet P can be mounted and removed in the right paper holder 34*a*. The guide position D2 indicates a state in which the sheet P is supported by the right paper holder 34*a* so as not to be attached and detached, and the sheet P transported in the transport direction F is guided by the right paper holder 34*a*. The pressing-in position D3 will be described later.

The right paper holder 34*a* includes a first engagement portion 91 in addition to the reception portion 96 and the guide portion 97 described above. The first engagement portion 91 is a link lever that couples an abutment arm 92 and an engagement arm 94 by an arm shaft 93, and a spring 95 is disposed on the arm shaft 93.

The abutment arm 92 is a rod-like member that abuts the cover 60 of the printing apparatus 1 and protrudes from the right paper holder 34*a*. The arm shaft 93 is a shaft provided upright on the reception portion 96, and rotatably supports the abutment arm 92 and the engagement arm 94.

As illustrated in FIG. 11, the abutment arm 92 and the engagement arm 94 sequentially overlap each other in a width direction of the printing apparatus main body 10, and the abutment arm 92 is located on the right side.

The spring 95 is a torsion coil spring, and is fixed by the coil portion 95*a* inserted into the arm shaft 93. One end of the spring 95 engages with the abutment arm 92, and the other end engages with the engagement arm 94. The abutment arm 92 and the engagement arm 94 are biased by the spring 95 so as to maintain predetermined relative positions with the arm shaft 93 as the center. Specifically, the abutment arm 92 and the engagement arm 94 are biased by the spring 95 so as to maintain the relative positions in the open position D1. When an external force is applied to the abutment arm 92, the abutment arm 92 and the engagement arm 94 maintain the relative positions in the open position D1 and rotationally move around the arm shaft 93. Here, when an external force greater than or equal to a predetermined force is applied between the abutment arm 92 and the engagement arm 94, the abutment arm 92 and the engagement arm 94 are displaced from each other against the biasing force of the spring 95.

The abutment arm 92 protrudes from the arm shaft 93 toward the upstream side in the transport direction F. A tip portion of the abutment arm 92 is bent in a direction away from the guide surface 33*b*, and the bent tip is an abutment portion 92*a*. As described later, the abutment portion 92*a* abuts a second engagement portion 61 provided on the cover 60 of the printing apparatus 1. A tip of the abutment portion 92*a* is processed into a curved surface so as to be slippery in a state of abutting the second engagement portion 61.

On the other hand, a tip of the engagement arm 94 extends toward the guide surface 33*b* side, and an engagement portion 94*a* that engages with the guide portion 97 is provided on the tip portion of the engagement arm 94.

The reception portion 96 includes a reception portion frame 96*a*, and the arm shaft 93 is provided upright on the reception portion frame 96*a*. Further, the guide portion 97 is rotatably supported by a rotational movement shaft 96*i* in a lower portion of the reception portion 96. The rotational movement shaft 96*i* is, for example, a shaft parallel to the transport direction F.

The reception portion 96 is provided with a counter surface 96*b* that sandwiches the sheet P with the guide portion 97, and a regulating surface 96*c* that regulates movement in the left-and-right direction of the sheet P. The counter surface 96*b* is a surface being substantially parallel to the guide surface 33*b*, and is disposed in a rotational movement range of the guide portion 97. The guide portion 97 contacts an upper surface of the sheet P, and the counter surface 96*b* contacts a lower surface of the sheet P, thereby supporting the sheet P. The counter surface 96*b* extends in the left direction with respect to the reception portion frame 96*e* and is formed in a shape of ascending toward its tip, and thus it is possible to prevent folding and bending of the side end portion of the sheet P.

The regulating surface 96*c* is a surface in a direction intersecting the guide surface 33*b*, and extends along the transport direction F. Since the regulating surface 96*c* is configured at an acute angle with respect to the counter surface 96*b*, the side end of the sheet P such as a die cutting label sheet can be effectively regulated.

Although not illustrated in the drawings, the printing apparatus 1 is also provided with a configuration being left-right symmetrical with the right paper holder 34*a* in the left paper holder 34*b*. In this way, the sheet P during transport can be guided by supporting the side end portion of the sheet P while preventing folding and bending of the side end portion of the sheet P.

Note that the regulating surface 96*c* may be provided on the guide portion 97. For example, in the guide position D2, the regulating surface of the guide portion 97 can be configured to regulate the movement in the left-and-right direction of the sheet P.

The guide portion 97 is rotatably supported by the rotational movement shaft 96*i*, and is displaced into the open position D1 and the guide position D2 illustrated in FIG. 11. The guide portion 97 includes a sheet pressing body 97*a* that faces the counter surface 96*b* in the guide position D2. The sheet pressing body 97*a* is a surface that contacts the sheet P in the guide position D2, and sandwiches the sheet P with the counter surface 96*b*.

The sheet pressing body 97*a* is inserted into an insertion hole 97*b* formed in a guide portion frame 97*f* of the guide portion 97. A spring 97*c* that biases the guide portion frame 97*f* and the sheet pressing body 97*a* is disposed inside the insertion hole 97*b*. Further, the protrusion of the sheet pressing body 97*a* from the guide portion frame 97*f* is regulated by a stopper (not illustrated) provided on the guide portion 97. The spring 97*c* is constituted by a compression coil spring, and biases the sheet pressing body 97*a* with a predetermined force toward the sheet P in the guide position D2. In other words, the sheet P is pressed by the sheet pressing body 97*a* with the biasing force of the spring 97*c*. This configuration can stabilize the pressing force applied to the sheet P, and does not hinder transport of the sheet P caused by pressing the sheet P excessively, for example.

Note that, in the left paper holder 34*b*, two sheet pressing bodies 197*a* are provided on the guide portion 197 and press the left-side end portion of the sheet P.

A biasing member 99 is disposed between the guide portion 97 and the reception portion 96. The biasing member 99 is disposed in engagement with the rotational movement shaft 96*i*, and includes a torsion coil spring (not illustrated).

A first locking portion 97*d* is formed on the reception portion frame 96*a* side of the guide portion 97, and a second locking portion 96*g* is formed on a surface of the guide portion frame 97 side of the reception portion frame 96*a*. The biasing member 99 is located between the first locking portion 97*d* and the second locking portion 96*g*, and biases the first locking portion 97*d* and the second locking portion 96*g* in a direction of being closer to each other with the biasing force of the torsion coil spring. In other words, the biasing member 99 biases, toward the open position D1 side, the guide portion 97 that rotationally moves around the rotational movement shaft 96*i*. Therefore, in a state in which no external force is applied, the guide portion 97 is located in the open position D1 by the biasing force of the biasing member 99. The rotational movement range of the guide portion 97 is limited between the open position D1 and the guide position D2 by a stopper (not illustrated) disposed on the reception portion frame 96*a*.

The guide portion 97 is disposed on the left side of the engagement arm 94, and an edge portion 97*e* on the engagement arm 94 side engages with the engagement portion 94*a* that is the tip of the engagement arm 94 in the open position D1. In the open position D1, the edge portion 97*e* is located in the lower portion in FIG. 11, that is, near the guide surface 33*b*. The engagement arm 94 is rotationally moved as described below, and thus the edge portion 97*e* is lifted by the engagement portion 94*a* and pressed in a direction away from the guide surface 33*b*. With this pressing force, the guide portion 97 rotationally moves around the rotational movement shaft 96*i*, and is displaced from the open position D1 to the guide position D2.

The left paper holder 34*b* has a configuration being left-right symmetrical with the right paper holder 34*a*, and includes a first engagement portion 191 corresponding to the first engagement portion 91 of the right paper holder 34*a*, a reception portion 196 corresponding to the reception portion 96, and a guide portion 197 corresponding to the guide portion 97. Further, the left paper holder 34*b* includes an abutment arm 192 and an engagement arm 194 corresponding to the abutment arm 92 and the engagement arm 94 of the right paper holder 34*a*. Therefore, the configuration and the operation of the left paper holder 34*b* are similar to those of the right paper holder 34*a* described above, and thus a part of illustration and description thereof will be omitted.

The sheet guide mechanism 90 can be accessed while the cover 60 is open. When the sheet guide mechanism 90 is loaded with the sheet P and when the sheet P is removed, the cover 60 is opened in the first open position C1 or the second open position C2, and an operation can be performed on the paper holder 34.

When the cover 60 is located in the first open position C1 or the second open position C2, the right paper holder 34*a* and the left paper holder 34*b* are located in the open position D1.

In the process in which the cover 60 is closed from the first open position C1 or the second open position C2 to the closed position C0, a pressing force is applied to the right paper holder 34*a* and the left paper holder 34*b* from the cover 60, and the right paper holder 34*a* and the left paper holder 34*b* are displaced to the guide position D2 and sandwich the sheet P.

As illustrated in FIG. 7, the second engagement portion 61 that protrudes toward the housing portion 21 in the closed position C0 is provided on a back surface 60*b* of the cover 60. The second engagement portion 61 includes a right engagement body 61*a* and a left engagement body 61*b*.

The left engagement body 61*b* is provided in a position facing the left paper holder 34*b* on the left side of the cover 60 in the closed position C0. The right engagement body 61*a* is disposed on the right side with respect to the left engagement body 61*b*. The right engagement body 61*a* is provided so as to extend in the left-and-right direction of the printing apparatus main body 10, and is disposed so as to correspond to a range in which the right paper holder 34*a* is movable along the guide opening 33*a*. Thus, even when the right paper holder 34*a* is moved along the guide opening 33*a*, the right engagement body 61*a* is located in a position corresponding to the right paper holder 34*a*.

In a position between the first open position C1 or the second open position C2 and the closed position C0, the right engagement body 61*a* abuts the first engagement portion 91 of the right paper holder 34*a* located in the open position D1. Similarly, the left engagement body 61*b* abuts the abutment arm 192 of the first engagement portion 191 located in the open position D1. When the cover 60 further moves closer to the closed position C0, the right engagement body 61*a* presses the abutment arm 92, and the left engagement body 61*b* presses the abutment arm 192.

In the right paper holder 34*a*, the abutment portion 92*a* is pressed by the right engagement body 61*a*, and thus the abutment arm 92 rotationally moves in an R6 direction illustrated in FIG. 10. Accordingly, the abutment arms 92 and the engagement arm 94 are displaced from the open position D1 to the guide position D2.

Displacement of the engagement arm 94 causes the engagement portion 94*a* to push the edge portion 97*e* as illustrated in FIG. 11 and to rotationally move the guide portion 97 in an R5 direction against the biasing force of the biasing member 99.

The guide portion 97 reaches the guide position D2 before the cover 60 reaches the closed position C0. When the cover 60 is further displaced and reaches the closed position C0, the abutment arm 92 rotationally moves farther than the guide position D2 and reaches the pressing-in position D3 in FIG. 10.

In the process in which the abutment arm 92 is displaced from the guide position D2 to the pressing-in position D3, the guide portion 97 is located in the guide position D2, and a force is further applied to the guide portion 97 from the engagement arm 94. However, in the printing apparatus 1, the abutment arm 92 and the engagement arm 94 are not fixed, and the engagement arm 94 is configured to be coupled to the abutment arm 92 via the spring 95. Thus, when a force greater than the biasing force of the spring 95 is applied between the abutment arm 92 and the engagement arm 94, the spring 95 becomes deformed and absorbs an excessive force. Thus, an excessive force is not applied to the guide portion 97 from the engagement arm 94.

Furthermore, the rotational movement range of the guide portion 97 is limited by the stopper (not illustrated) disposed on the reception portion frame 96*a*, and the guide portion 97 does not approach the guide opening 33*a* beyond the guide position D2. Thus, the force applied to the sheet P from the right paper holder 34*a* does not exceed the biasing force of the spring 97*c*. Therefore, the sheet P can be pressed with an appropriate force by the right paper holder 34*a* and be supported, and transport of the sheet P is not hindered.

Further, in a state in which the cover 60 is located in the closed position C0, the abutment arm 92 is located in the pressing-in position D3 and is supported by the biasing force of the spring 95. In this state, a state in which the right paper holder 34*a* presses the sheet P is not released, and thus the sheet P can be stably transported. Further, unsteadiness of a component in the right paper holder 34*a* can be prevented.

The operation described above applies to both of a case in which the cover 60 is closed from the first open position C1 and is moved to the closed position C0, and a case in which the cover 60 is closed from the second open position C2.

Further, when the cover 60 is opened from the closed position C0 to the first open position C1 or the second open position C2, the rotational movement of the cover 60 causes the right engagement body 61*a* to move in a direction away from the abutment arm 92 and the left engagement body 61*b* to move in a direction away from the abutment arm 192.

Accordingly, the abutment arm 92 moves from the pressing-in position D3 toward the open position D1 through the guide position D2. The engagement arm 94 rotationally moves due to the displacement of the abutment arm 92, and the engagement portion 94*a* moves downward away from the edge portion 97*e*. In this process, the guide portion 97 is displaced from the guide position D2 to the open position D1 by the biasing force of the biasing member 99, and the pressing force between the reception portion 96 and the guide portion 97 sandwiching the sheet P is released.

Then, when the guide portion 97 moves to the open position D1 by the rotational movement of the cover 60, the sheet pressing body 97*a* is separated from the sheet P, and the operation of removing the sheet P from the paper holder 34 and the operation of mounting the sheet P on the paper holder 34 can be performed.

Further, the right engagement body 61*a* and the left engagement body 61*b* respectively abut the abutment arm 92 and the abutment arm 192, and slide due to the displacement of the cover 60. Thus, the surfaces of the right engagement body 61*a* and the left engagement body 61*b* may be a smooth curved surface or a flat surface.

As described above, the sheet guide mechanism 90 according to the exemplary embodiments is the sheet guide mechanism 90 for sandwiching the sheet P being a sheet medium between the reception portion 96 and the guide portion 97 and guiding the sheet P. The guide portion 97 is configured to be movable to the guide position D2 in which the guide portion 97 faces the reception portion 96 and sandwiches the sheet P and to the open position D1 in which the sheet P can be inserted and removed between the reception portion 96 and the guide portion 97. The sheet guide mechanism 90 includes the cover 60 configured to cover the sheet P, and the first engagement portion 91 configured to engage with the guide portion 97, and move the guide portion 97 to the guide position D2. The cover 60 is movable to the closed position C0 in which the cover 60 covers the sheet P and to the first open position C1 or the second open position C2 being an open position in which the cover 60 forms an opening that allows handling of the sheet P. The cover 60 includes the second engagement portion 61 configured to contact the first engagement portion 91 in the closed position C0. In the process in which the cover 60 moves to the closed position C0, the second engagement portion 61 contacts the first engagement portion 91 to displace the first engagement portion 91, and thus the guide portion 97 moves to the guide position D2. In the process in which the cover 60 moves from the closed position C0 to the first open position C1 or the second open position C2, the second engagement portion 61 and the first engagement portion 91 are separated, and the guide portion 97 moves from the guide position D2 to the open position D1.

According to the sheet guide mechanism 90 to which the present disclosure is applied and the printing apparatus 1 including the sheet guide mechanism 90, the sheet P is sandwiched between the reception portion 96 and the guide portion 97 by the operation of closing the cover 60, and the sheet guide mechanism 90 is brought into a state in which the sheet P can be guided. In this way, the work for loading the sheet P is performed in a few steps, and a work burden is extremely small. Further, the state in which the sheet guide mechanism 90 sandwiches the sheet P is released by opening the cover 60, and thus the work for removing the sheet P is also performed in a few steps, and a work burden is extremely small.

The sheet guide mechanism 90 includes the biasing member 99 configured to bias the guide portion 97 toward the open position D1. In the sheet guide mechanism 90, in the process in which the cover 60 moves to the closed position C0, the guide portion 97 is pressed, by the first engagement portion 91, against the biasing force of the biasing member 99, and the guide portion 97 moves to the guide position D2. In this way, in conjunction with the operation of opening and closing the cover 60, the sheet P is sandwiched by the sheet guide mechanism 90 or the sandwiching is released. Therefore, the work for loading and removing the sheet P in the printing apparatus 1 needs an extremely few steps.

The reception portion 96 and the guide portion 97 are disposed at two locations away from each other in the width direction intersecting the transport direction F of the sheet P. At least any of the reception portion 96 and the guide portion 97 includes the regulating surface 96*c* that abuts the sheet P and regulates the movement in the width direction of the sheet P. In this way, the movement in the width direction during transport of the sheet P and the movement in the direction intersecting a plane of the sheet P can be regulated, and the sheet P can be stably transported.

In the sheet guide mechanism 90, at least one of the two reception portions 96 and 196 is movable in the width direction of the sheet P. In the exemplary embodiments described above, the right paper holder 34*a* is movable along the guide opening 33*a*. According to this configuration, a position of the guide portion can be adjusted in accordance with a width of the sheet P.

Each of the exemplary embodiments described above merely represents one aspect of the present disclosure, and the specific aspects of the present disclosure and the scope of application of the present disclosure are not limited to the exemplary embodiments described above.

For example, in the exemplary embodiments described above, the configuration in which the right paper holder 34*a* is movable along the guide opening 33*a*, and the left paper holder 34*b* is fixed is exemplified. However, the present disclosure is not limited to this configuration. For example, the left paper holder 34*b* may be movable along the guide opening 33*a*.

Further, for example, the printing apparatus 1 is configured to include the cover 60 that can be opened to the first open position C1 and the second open position C2, but may be configured to be able to be opened to only one of the first open position C1 and the second open position C2. In this case, the effect of the exemplary embodiments described above can also be obtained by the sheet guide mechanism 90.

Further, the sheet P that can be guided by the printing apparatus 1 with the sheet guide mechanism 90 may be a sheet in which sprocket holes are provided in both side end portions, in addition to roll paper and fanfold paper in which both side end portions are cut off. In addition, the sheet P may be a printing medium made from a material other than paper, or may be a surface coated printing medium.

Furthermore, the sheet guide mechanism 90 is not limited to the configuration that guides a printing medium in the printing apparatus 1, and is applicable to a scanner, a laminating device, or various types of apparatuses that transport other sheet-like medium.

What is claimed is:

1. A sheet guide mechanism for sandwiching a sheet medium between a reception portion and a guide portion and for guiding the sheet medium, the guide portion being configured to be movable to a guide position in which the guide portion faces the reception portion to sandwich the sheet medium, and to an open position in which the sheet medium is insertable and removable from between the reception portion and the guide portion, the sheet guide mechanism comprising:

a first engagement portion configured to engage with the guide portion to move the guide portion to the guide position;

a cover configured to cover the sheet medium and includes a second engagement portion configured to contact the first engagement portion in a closed position; and a biasing member configured to bias the guide portion toward the open position, wherein the cover is movable to the closed position in which the cover covers the sheet medium, and to an open position in which the cover forms an opening that allows handling of the sheet medium, while the cover moves to the closed position, the second engagement portion contacts the first engagement portion to displace the first engagement portion, the guide portion is pressed, by the first engagement portion, against a biasing force of the biasing member, and thus the guide portion moves to the guide position, and while the cover moves from the closed position to the open position, the second engagement portion and the first engagement portion are separated, and the guide portion moves from the guide position to the open position by the biasing force of the biasing member.

2. The sheet guide mechanism according to claim 1, wherein the reception portion and the guide portion are disposed at two locations away from each other in a width direction intersecting a transport direction of the sheet medium, and at least one of the reception portion and the guide portion includes a regulating surface that abuts the sheet medium to regulate movement in the width direction of the sheet medium.

3. The sheet guide mechanism according to claim 2, wherein the guide sheet mechanism includes one or more reception portions, and at least one reception portion is movable in the width direction of the sheet medium.

4. A printing apparatus, comprising:

a transport unit configured to transport the sheet medium;

a printing unit configured to perform printing on the sheet medium; and the sheet guide mechanism according to claim 1, wherein the sheet medium transported by the transport unit is guided by the sheet guide mechanism.

* * * * *